US006055678A

United States Patent [19]

Ng

[11] Patent Number: 6,055,678

[45] Date of Patent: May 2, 2000

[54] DISPENSER SYSTEM IN A WATER TANK

[76] Inventor: Kim Kwee Ng, P.O. Box 379, Selden Post Office, Selden, N.Y. 11784-0379

[21] Appl. No.: 09/014,924

[22] Filed: Jan. 28, 1998

[51] Int. Cl.[7] ..... E03D 9/03

[52] U.S. Cl. ..... 4/227.4

[58] Field of Search ..... 4/227.4, 227.5, 4/227.6

[56] References Cited

U.S. PATENT DOCUMENTS

| | | | |
|---|---|---|---|
| 495,563 | 4/1893 | Plumb | 4/227.4 |
| 5,038,416 | 8/1991 | Horne et al. | 4/227.6 |

FOREIGN PATENT DOCUMENTS

| | | | |
|---|---|---|---|
| 7904220 | 12/1980 | Netherlands | 4/227.4 |
| 148821 | 2/1955 | Sweden | 4/227.4 |

*Primary Examiner*—Robert M. Fetsuga

[57] ABSTRACT

A dispenser system for dispensing a variety of soluble agents in the cistern of a sanitary device including toilet and the like. The system comprises members supporting a dispenser container removably attachable to a wall member of the cistern and partially submerged in the water of the cistern. The dispenser container includes means in the lower portion of the dispenser for confining a soluble agent such as a cleaning agent or a deodorizing agent. When the sanitary device is flushed, the cleaning agent or the deodorizing agent exits the dispensing system and mingles with the flushing water near the end of the flushing cycle. A barrier in the dispenser container serves to help form a concentrated reservoir for the aqueous solution of the soluble agent. In another embodiment of the invention, accessory compartments holding different soluble agents are provided by a plurality of removable partitions. An additional embodiment of the invention features a cylindrical container having multiple compartments to store a variety of soluble materials. Selectively aligning a compartment holding a desired soluble agent with a means for selective access to the water of the cistern, whereby the selected soluble material exits into the cistern and mingles with the flushing water flowing to the toilet bowl.

4 Claims, 4 Drawing Sheets

DISPENSER SYSTEM IN A WATER TANK

FIELD OF THE INVENTION

This invention relates generally to sanitary devices and more specifically to a dispensing system for a variety of soluble water-conditioning agents in a water tank.

DESCRIPTION OF THE PRIOR ART

U.S. Pat. No. 5,673,439 "Toilet detergent dispenser" describes the use of a detergent dispenser for a toilet. The detergent dispenser includes a body having an inlet chamber with an inlet connected to a water source, and an outlet chamber having an inlet conduit connected to a water tank. A compartment containing detergent is defined therein and communicating with the inlet chamber and the outlet chamber. A valve member is mounted to the inlet and includes a biasing member to urge the valve member to block the inlet when not flushing. A resilient water sealing member is mounted to allow water which enters the compartment to exit the body via the outlet chamber during flushing and to close the compartment when not flushing.

U.S. Pat. No. 5,603,126 "Toilet disinfectant dispenser" describes a flush toilet apparatus including a container for a solid disinfectant having an inlet port and an outlet port. A facility is provided for feeding some of the water from a float valve assembly connected to a water supply into the inlet port of the container. Water that enters the container dissolves a predetermined amount of the disinfectant, which then exits the outlet port, to finally enter the toilet bowl after flushing.

SUMMARY OF THE INVENTION

The primary object of the invention is to treat the bowl surface and bowl water in a toilet with soluble disinfectant and deodorizing agents.

A further object is to provide a variety of solutions for selectively conditioning the contents of the toilet bowl and the bowl surface.

An additional object is to provide for sequential treatment of the bowl surface and the bowl water with two or more different soluble agents.

A still further object is to provide a dispensing system which is both simple to use and maintain and is economical to manufacture.

Further objects of the invention will become apparent as brought out from a study of the drawings and the description of the invention.

DESCRIPTION OF THE PREFERRED EMBODIMENTS

A more complete understanding of my invention may be obtained through a study of this description when taken together with the appended drawings, wherein like reference symbols refer to like elements of the drawings.

Figure 1:
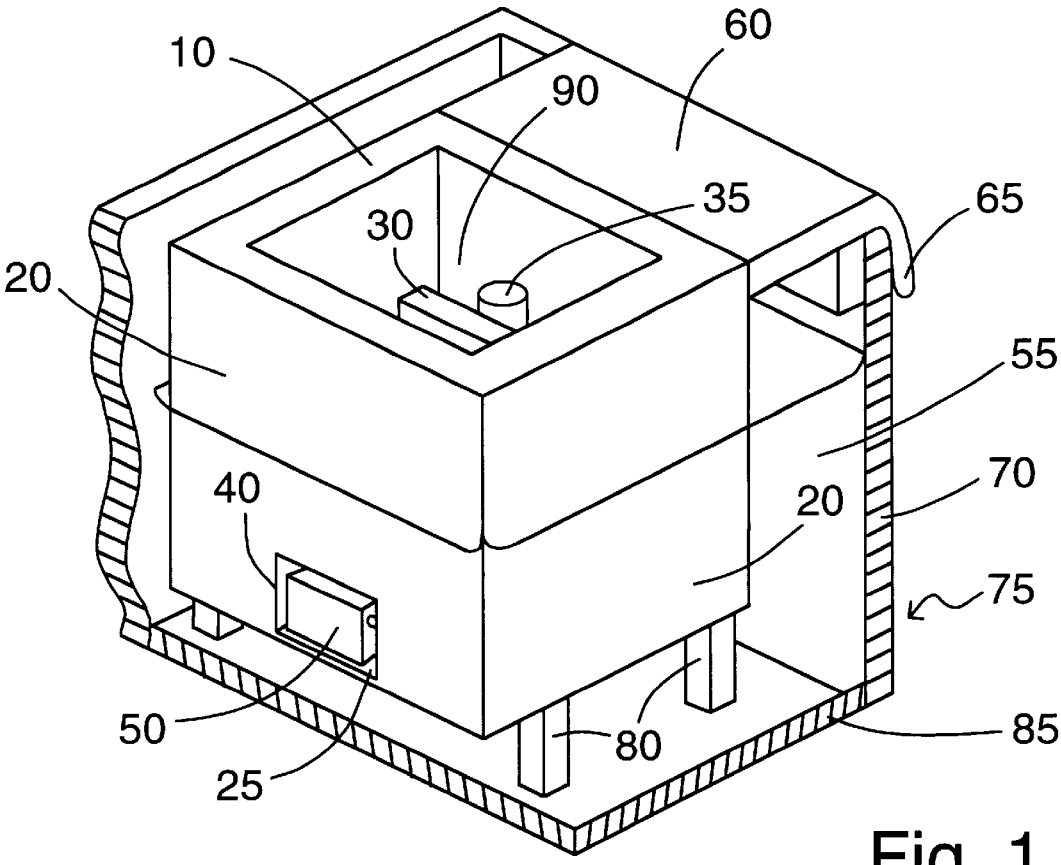
FIG. 1 is a simplified perspective drawing of a first preferred embodiment of the invention using a dispenser container inside a toilet cistern.

A first preferred embodiment of my invention as illustrated in FIG. 1, has a dispenser container tank 10 constructed of upwardly wall members 20 rising from a rectangular base 25. Tank 10 has a transverse partition 30 defining a compartment for a water soluble material 35, for example, a cleaning agent, a disinfectant or a deodorizing agent. Said compartment being distant from an opening 40 in a lower portion of a wall member 20 parallel to partition 30. Hinged flap 50, constituting a means for allowing flow of liquid into and out of tank 10 through opening 40 is free to rotate through an arc of about 180 degrees in response to changing water pressure on its vertical faces. Hinged flap 50 operates to close off opening 40 in upright wall member 20 of the tank 10 when there is an equilibrium of water pressure on both sides of flap 50 and to rotate to allow water 55 to flow when there is no equilibrium. A supporting arm 60 extending from an upright wall member 20 of tank 10 has a downwardly extending flange member 65 adapted to secure engagement with a wall member 70 of a water cistern 75, also known as water tank, partially shown.

Tank 10 is supported by a plurality of leg members 80, raising tank 10 above the floor 85 of cistern 75. When the toilet is flushed, the water level in the cistern 75 lowers during the outflow of water to a toilet bowl, not shown. When the water level in tank 10 becomes low enough there is an imbalance of the water pressure acting on the opposite sides of hinged flap 50 and water in the tank 10 exits through opening 40 responsive to rotation of hinged flap 50 joining with the water 55 exiting cistern 75 and flushing the toilet bowl, not shown. After flushing, cistern 75 is replenished with water from supply mains, not shown. During replenishment and as the level of water 55 in cistern 75 rises, some of the water 55 in the cistern 75 enters tank 10 through opening 40 passing hinged flap 50. When the water level in the tank 10 reaches an equilibrium state with the water in the cistern 75, hinged flap 50 closes automatically.

Tank 10 contains a transverse interior wall member, 30 of suitable height less than the maximum height of wall member 20 and below the height of the maximum water level in tank 10. A soluble treatment agent 35 is placed on the side of transverse interior wall member 30 distant from opening 40 to provide a reservoir of concentrated solution containing soluble agent 35 which replenishes the concentrated solution of treatment agent 35 in the flushing compartment 90 of tank 10 between flushings.

Figure 2:
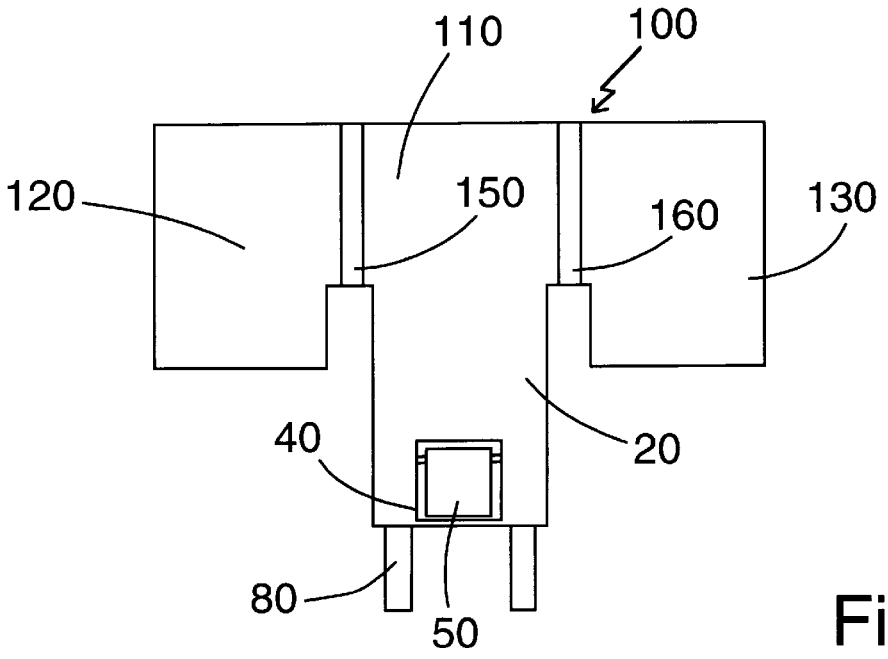
FIG. 2 is a simplified drawing of a front elevation of another preferred embodiment of the invention wherein the dispenser container has multiple compartments.

Referring now to FIG. 2, which shows a front elevation of a second preferred embodiment of my invention, dispenser container 100 comprises a main compartment 110 and a plurality of supplementary compartments, 120 and 130. The main compartment 110 has a hinged flap 50 in an opening 40 located at a lower terminal of an upright wall member 20 of main compartment 110. Hinged flap 50 allows water to flow whenever there is a pressure difference on either sides of the hinged flap 50. The two supplementary compartments, 120 and 130 are separated from the main compartment 110 by two removable water-tight partitions 150 and 160. Compartment 120 may hold a treating agent of a first type while compartment 130 holds a treating agent of a second type. Selecting a treating agent of either type may be done by simply removing one partition, 150 or 160, at a time from dispenser container 100.

Figure 3:
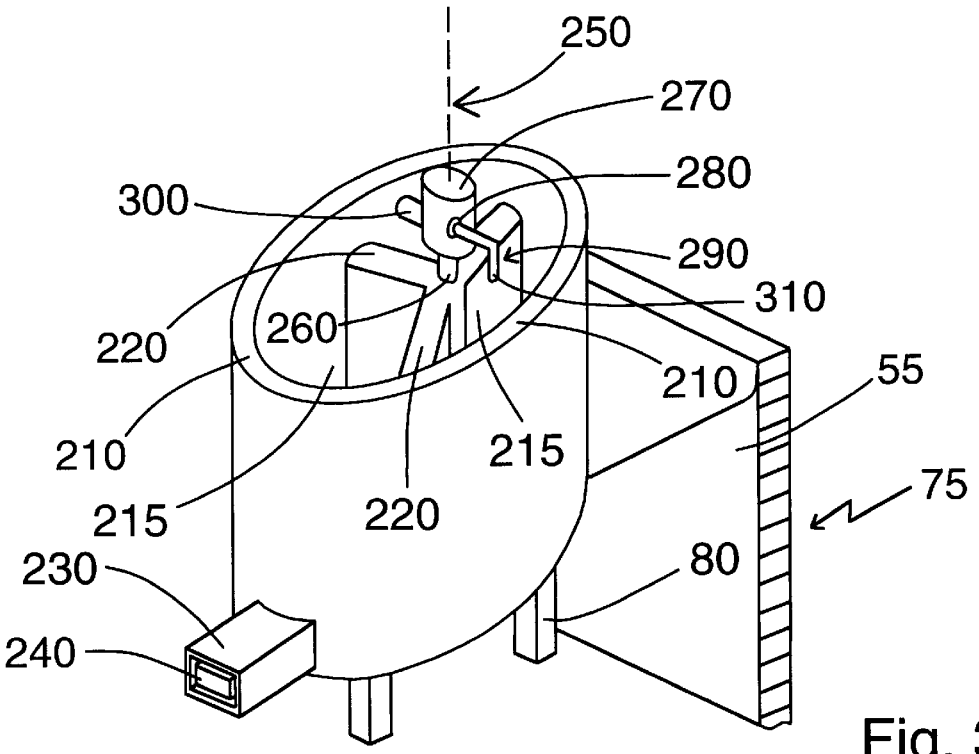
FIG. 3 is a simplified perspective drawing of a third preferred embodiment of the invention wherein the dispenser comprises a cylindrical container divided into multiple compartments.

Referring now to FIG. 3, which shows a third preferred embodiment of my invention for use with a cylindrical container 210, cylindrical container 210 is shown subdivided into a plurality of compartments 215 by partitions 220 to provide separate compartments for selective use of a different water-conditioning material in each compartment. These materials include cleaning agents, disinfectants, deodorizers and the like. Cylindrical container 210 is provided with a conduit 230 mounting a hinged flap 240 immersed in water 55 of water cistern 75, partially shown. Water in the cylindrical container 210 is allowed to flow through a through opening in the wall of the cylindrical container 210 to the conduit 230. Partitions 220 are rotatable about the vertical axis 250 of cylindrical container 210 on an axle 260 secured to the bottom of cylindrical container 210. Cylindrical axle 260 has an enlarged terminal member 270 having a trans-axial opening 280 adapted to through penetration of one leg of a L-shaped member 290. L-shaped member 290 is secured to terminal member 270 by a threaded fastener 300 at one of its ends and may be rotated about the axis of the leg penetrating opening 280. When a leg 310 of the L-shaped member 290 is rotated into the up position, a one of the compartments 215 containing a desirable soluble agent for action on the toilet bowl can be rotated for alignment with conduit 230. The leg 310 of L-shaped member 290 is then rotated to the down position to prevent partitions 220 from further rotation. Alternatively, the L-shaped member 290 can be removed by releasing the threaded fastener 300 from L-shaped member 290. After aligning a selected one of compartments 215 to the conduit 230, the L-shaped member 290 is remounted to enlarged terminal member 270 by threaded fastener 300. Thus, the selected one of compartments 215 is secured to the cylindrical container 210 in immovable relationship with wall member of cylindrical container 210.

Figure 4:
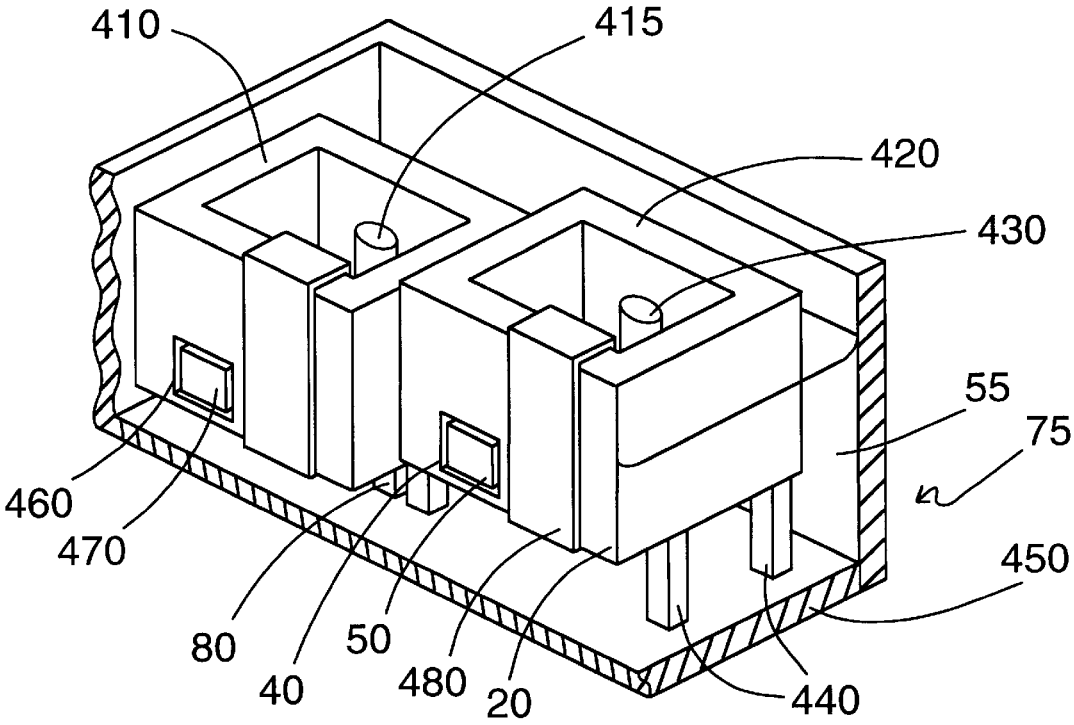
FIG. 4 is a simplified perspective drawing of a fourth preferred embodiment of the invention wherein a plurality of dispenser containers arranged to sequentially dispense toilet treatment agents.

Referring now to FIG. 4 of the drawings, a fourth preferred embodiment of my invention, a plurality of dispenser container tanks 410 and 420 is employed and positioned at different heights in the cistern 75, partially shown. Tank 410 contains a treating agent 415 of a first type, and tank 420 holds a treating agent 430 of a second type. When the toilet is flushed with water 55 in cistern 75, the water level in cistern 75 begins to fall. The aqueous solution of treating agent 430 in tank 420, which is mounted at a higher attitude by a plurality of leg members 440 rising from the floor 450 of cistern 75 than the tank 410 with a plurality of legs 80 in cistern 75, exits first as a result of the differential water pressure on opposite sides of hinged flap 50 through an opening 40 passing hinged flap 50 to join the water flushing the toilet bowl, not shown. As water level in cistern 75 continues to fall and there is an imbalance of water pressure acting on opposite sides of hinged flap 470, the aqueous solution of the treating agent 415 in tank 410 exits next through an opening 460 in tank 410 passing hinged flap 470 to the toilet bowl near the end of the flushing cycle. A blocking device 480, which has a form of an inverted u-shape, is slidable along the vertical faces of an upright wall member 20 of tank 420. When the hinged flap 50 is blocked by the slidable blocking device 480, the aqueous solution of the treating agent 430 is barred from exiting the hinged flap 50 to mingle with water flushing the toilet bowl, not shown. Thus, the blocking device 480 serves in selecting a variety of soluble agents in a multi-container system for action on the toilet bowl at a given time.

Figure 5:
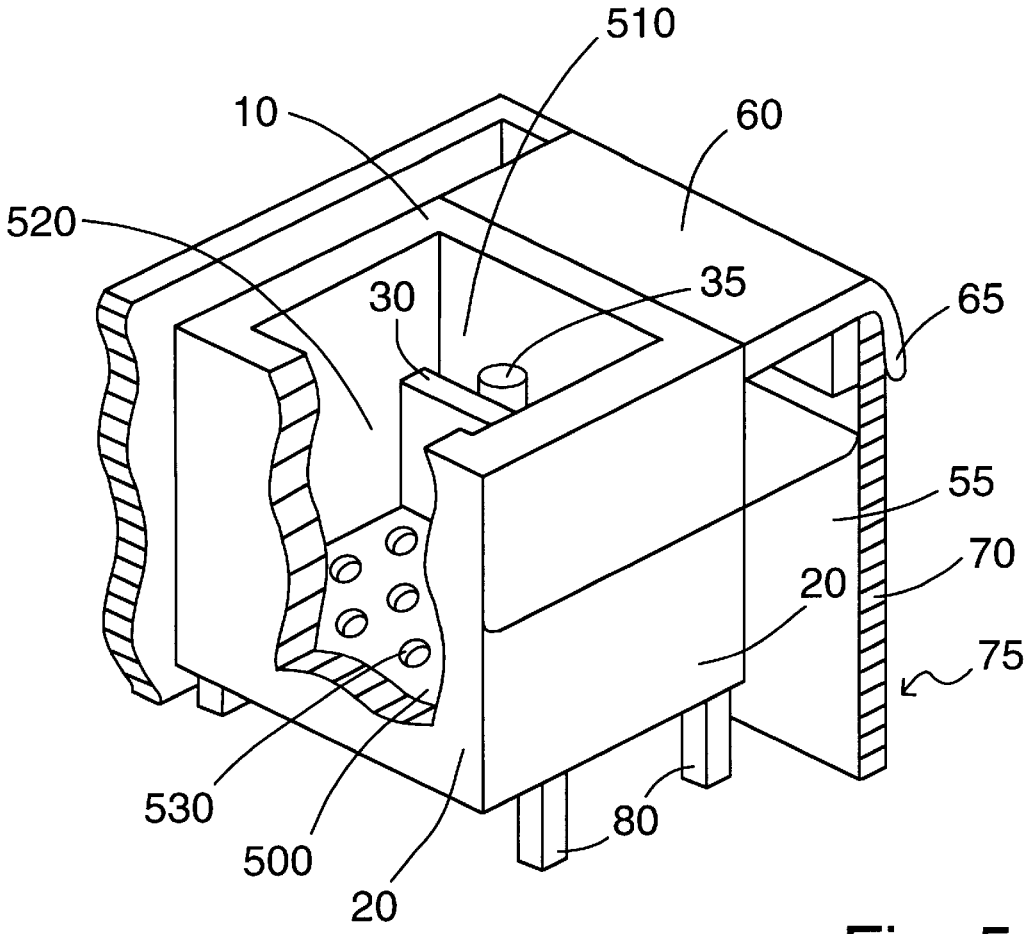
FIG. 5 is a simplified perspective partial view of a fifth preferred embodiment of the invention using orifices in a dispenser container for storing and dispensing a solution of a treatment agent.

Referring now to FIG. 5 of the drawings, a fifth preferred partial embodiment of my invention, dispenser container tank 10 is made of upwardly wall members 20 rising from a rectangular base 500. Tank 10 has a transverse partition 30 defining a first compartment 510 for holding a water soluble material 35. The second compartment 520 has a plurality of orifices 530. Water in the second compartment 520, after having been mixed with the concentrated aqueous solution of the soluble agent 35 in compartment 510, exits through the orifices 530 to the toilet bowl, not shown, during flushing. Water in cistern 75 enters the tank 10 through orifices 530 in the second compartment 520 of tank 10 during refilling. The transverse partition 30 in tank 10 has a height less than the maximum water level in cistern 75. A supporting arm 60 extending from an upright wall member 20 of tank 10 has a downwardly extending flange member 65 adapted to secure engagement with a wall member 70 of cistern 75, partially shown.

Having described the invention and its preferred modes of operation in sufficient detail for those of normal skill in the art to practice the same, it will be obvious to such practitioners to make certain changes and variation in the specific elements of the disclosed embodiments without departing from the scope of the invention. For example, an elastic band or the like may be attached to an edge of the hinged flap 50 of FIG. 1 to assure that the hinged flap is closed and opens only when there is a pressure difference on either sides of the hinged flap. The dispenser container 10 of FIG. 1 described in this invention is generally rectangular in shape. Shapes of other types may also be applicable. It is obvious that a plate, a barrier or a blocking device of other shapes or types could be employed to block a one of the hinged flaps from operation in a multiple dispenser container system, thus allowing or disallowing a specific soluble agent contained therein to join the flushing action of the toilet bowl at a given time. The transverse interior wall member 30 of FIG. 1 needs not be a rectangular plate of finite size, it may comprise a plurality of walls surrounding the hinged flap 50, or it could also be a circular well inside the dispenser container 10 of FIG. 1. The transverse interior wall member 30 may be populated with a plurality of through openings to control the flow rate during frequent and repeated flushings of the toilet.

For these reasons, the scope of the invention should not be limited by that which has been illustrated herein but should be limited only by the scope of the appended claims:

I claim:

1. In a system having a water cistern where the water level changes rapidly during flushing and refilling, a device for dispensing soluble water-conditioning agents, comprising:

a) dispenser means for storing and dispensing said soluble water-conditioning agents, supportedly contained within said cistern; and, b) means comprising a hinged flap for allowing water to flow between said cistern and said dispenser means responsive to inbalance of water pressure between said cistern and said dispenser means.

2. The invention of claim 1 including means for dividing the interior of said dispenser means into a first compartment for storing said water-conditioning agents and a second compartment associated with said hinged flap.

3. The invention of claim 1 including a plurality of said dispenser means and means for supporting each said dispenser means at a selected height inside said cistern.

4. In a system having a water cistern where the water level changes rapidly during flushing and refilling, a device for dispensing soluble water-conditioning agents, comprising:

a) a plurality of dispenser means for storing and dispensing said soluble water-conditioning agents, supportedly contained within said cistern;

b) means comprising a hinged flap for allowing water to flow between said cistern and each said dispenser means responsive to imbalance of water pressure between said cistern and each said dispenser means; and, c) means for supporting each said dispenser means at a selected height inside said cistern.

* * * * *